US010620576B2

(12) United States Patent
Kooriya et al.

(10) Patent No.: US 10,620,576 B2
(45) Date of Patent: Apr. 14, 2020

(54) IMAGE FORMING APPARATUS

(71) Applicant: Konica Minolta, Inc., Chiyoda-ku, Tokyo (JP)

(72) Inventors: Takaaki Kooriya, Tokyo (JP); Hiroshige Kidera, Tokyo (JP); Daiki Yamanaka, Kanagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/232,221

(22) Filed: Dec. 26, 2018

(65) Prior Publication Data

US 2019/0196378 A1 Jun. 27, 2019

(30) Foreign Application Priority Data

Dec. 27, 2017 (JP) ..... 2017-251255

(51) Int. Cl.
*G03G 15/00* (2006.01)

(52) U.S. Cl.
CPC ..... *G03G 15/5033* (2013.01)

(58) Field of Classification Search
CPC .. G03G 15/161; G03G 15/166; G03G 15/168; G03G 15/1605; G03G 15/1615; G03G 15/6591; G03G 2215/119; G03G 2215/17; G03G 2215/1618
USPC ..... 399/38–41, 46, 49
See application file for complete search history.

(56) References Cited

U.S. PATENT DOCUMENTS 9,248,638 B2 * 2/2016 Yogosawa ..... G03G 21/169
9,547,249 B2 * 1/2017 Kochi ..... G03G 15/0131

FOREIGN PATENT DOCUMENTS

JP 2011123378 A 6/2011

* cited by examiner

*Primary Examiner* — Hoan H Tran
(74) *Attorney, Agent, or Firm* — Cantor Colburn LLP

(57) ABSTRACT

There is provided an image forming apparatus capable of suppressing fluctuation of sensor output. The image forming apparatus includes, an image bearing member, a photosensor and a hardware processor. The image bearing member has a layered structure in which a surface layer is laminated on a base material layer. The photosensor irradiates a surface of the image bearing member on which a toner image is formed with detection light on the basis of a predetermined detection condition, and receives reflected light of the detection light reflected from the surface of the image bearing member. The hardware processor controls at least a dominant wavelength of the photosensor among the predetermined detection conditions such that light interference and dark interference are included in the reflected light, and controls a toner adhesion amount onto the image bearing member on the basis of an output of the photosensor.

10 Claims, 17 Drawing Sheets

| SURFACE ROUGHNESS Rz (μm) | 0.1 | 0.2 | 0.4 | 0.5 | 0.6 | 0.8 |
|---|---|---|---|---|---|---|
| a | 0.7 | 1.3 | 2.5 | 3.2 | 3.8 | 5.1 |
| SENSOR OUTPUT VARIATION | C | B | B | B | A | A |

* VARIATION IN PHOTOSENSOR OUTPUT IS EVALUATED ON THE BASIS OF Vmax − Vmin AT THE TIME OF DETECTING ONE BELT CIRCUMFERENTIAL LENGTH

C: VARIATION WAS SUPPRESSED TO CERTAIN EXTENT

B: VARIATION WAS SUPPRESSED WITHIN ACCEPTABLE RANGE

A: VARIATION WAS SUFFICIENTLY SUPPRESSED

FIG. 11

| a | λp (nm) | EVALUATION |
|---|---|---|
| 0.75～1.25(N=1) | 4428～2657 | C |
| 1.75～2.25(N=2) | 1898～1476 | B |
| 2.75～3.25(N=3) | 1208～1022 | B |
| 3.75～4.25(N=4) | 886～781 | A |
| 4.75～5.25(N=5) | 699～633 | A |
| 5.75～6.25(N=6) | 578～531 | A |
| 6.75～7.25(N=7) | 492～458 | A |
| 7.75～8.25(N=8) | 429～403 | A |

C: VARIATION WAS SUPPRESSED TO CERTAIN EXTENT

B: VARIATION WAS SUPPRESSED WITHIN ACCEPTABLE RANGE

A: VARIATION WAS SUFFICIENTLY SUPPRESSED

FIG. 12

| DIFFUSION FILTER | DIFFUSION MAGNIFICATION |
|---|---|
| NONE | 1.0 TIME |
| A | 1.5 TIMES |
| B | 2.0 TIMES |
| C | 3.0 TIMES |

IMAGE FORMING APPARATUS

CROSS REFERENCE TO RELATED APPLICATIONS

The present application claims priority under 35 U.S.C. § 119 to Japanese patent Application No. 2017-251255 filed on Dec. 27, 2017, the entire content of which is incorporated herein by reference.

BACKGROUND

Technological Field

The present invention relates to an image forming apparatus.

Description of Related Art

In general, in an image forming apparatus (printer, copier, facsimile machine, etc.) using a technique of the electrophotographic process, a uniformly charged photoreceptor (e.g., photoconductor drum) is irradiated (subject to light exposure) with a laser light based on image data, whereby an electrostatic latent image is formed on a surface of the photoreceptor. Then, toner is supplied to the photoreceptor on which the electrostatic latent image is formed, whereby the electrostatic latent image is visualized to form a toner image. After the toner image is indirectly transferred to a sheet via an intermediate transfer belt, the toner image is heated and pressed by a fixing device, whereby an image is formed on the sheet.

A toner adhesion amount and image density on an image bearing member such as the photoconductor drum and the intermediate transfer belt are detected by an image density control (IDC) sensor. A sensor output is fed back to an image forming condition. In this manner, image stabilization control is performed.

In a case where a toner image formed on an intermediate transfer belt having a layered structure of two or more layers (e.g., base material layer and surface layer) is detected by an IDC sensor, interference intensity of light varies depending on surface roughness of an outermost layer of the surface layer and variation of a film thickness of the surface layer (hereinafter referred to as surface layer state). As a result, the sensor output fluctuates, whereby accuracy of the image stabilization control is lowered.

Hereinafter, a mechanism by which the sensor output fluctuates will be described with reference to FIG. 1. Monochromatic light having a specific wavelength is incident on the surface layer from the air. In this case, the light reflected on the upper surface of the surface layer and the light refracted at the upper surface of the surface layer and reflected on the lower surface of the surface layer are intensified by each other (light interference) or weakened by each other (dark interference). Note that n represents a refractive index of the surface layer, d represents a film thickness of the surface layer, θ2 represents a reflection angle of the light reflected on the lower surface of the surface layer, λ represents a wavelength of light, and m represents an integer of zero or more.

A condition of the light interference is expressed by the following formula (1).

$$2nd \cos \theta 2 = m\lambda \quad (1)$$

A condition of the dark interference is expressed by the following formula (2).

$$2nd \cos \theta 2 = (m+\tfrac{1}{2})\lambda \quad (2)$$

The formulae (1) and (2) mentioned above indicate that the interference intensity of light varies depending on film thickness d and the sensor output fluctuates.

An image forming apparatus configured in such a manner that interference fringes are not generated on an intermediate transfer belt has been disclosed (e.g., Japanese Patent Application Laid-Open No. 2011-123378).

Meanwhile, as illustrated in FIG. 2, roughness in the order from nm to μm (variation in film thickness in a minute region) exists in the outermost layer of the intermediate transfer belt. Further, in the surface of the intermediate transfer belt, variation in film thickness caused by coating unevenness on the surface layer and the like exists. Accordingly, as illustrated in FIG. 3, the interference intensity of light varies depending on the position at which the intermediate transfer belt is detected, whereby the sensor output fluctuates.

In a case where the toner image formed on the intermediate transfer belt is detected, the sensor output fluctuates due to the influence exerted by the surface layer state (surface roughness of the outermost layer and variation in film thickness of the surface layer) of the intermediate transfer belt, whereby the toner adhesion amount on the intermediate transfer belt is erroneously detected and erroneously corrected. In particular, the influence exerted by the surface layer state is likely to increase in the case where a halftone or highlight toner image is detected, whereby there has been a problem that the sensor output fluctuation increases.

SUMMARY

An object of the present invention is to provide an image forming apparatus capable of suppressing sensor output fluctuation.

In order to realize at least one of the above objects, an image forming apparatus includes:

a photosensor that has a layered structure in which a surface layer is laminated on a base material layer, the photosensor irradiating a surface of an image bearing member on which a toner image is formed with a detection light beam on the basis of one or more predetermined detection conditions, and receiving a reflected light beam of the detection light beam reflected from the surface of the image bearing member; and a hardware processor that controls at least a dominant wavelength of the photosensor among the one or more predetermined detection conditions such that light interference and dark interference are included in the reflected light beam, and that also controls a toner adhesion amount onto the image bearing member on the basis of an output of the photosensor.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 11 is a table illustrating an evaluation result of variation in output of the photosensor with respect to the surface roughness;

FIG. 12 is another table illustrating an evaluation result of the variation in output of the photosensor with respect to the surface roughness;

DETAILED DESCRIPTION OF EMBODIMENTS

Hereinafter, one or more embodiments of the present invention will be described with reference to the drawings. However, the scope of the invention is not limited to the disclosed embodiments.

Figure 1:
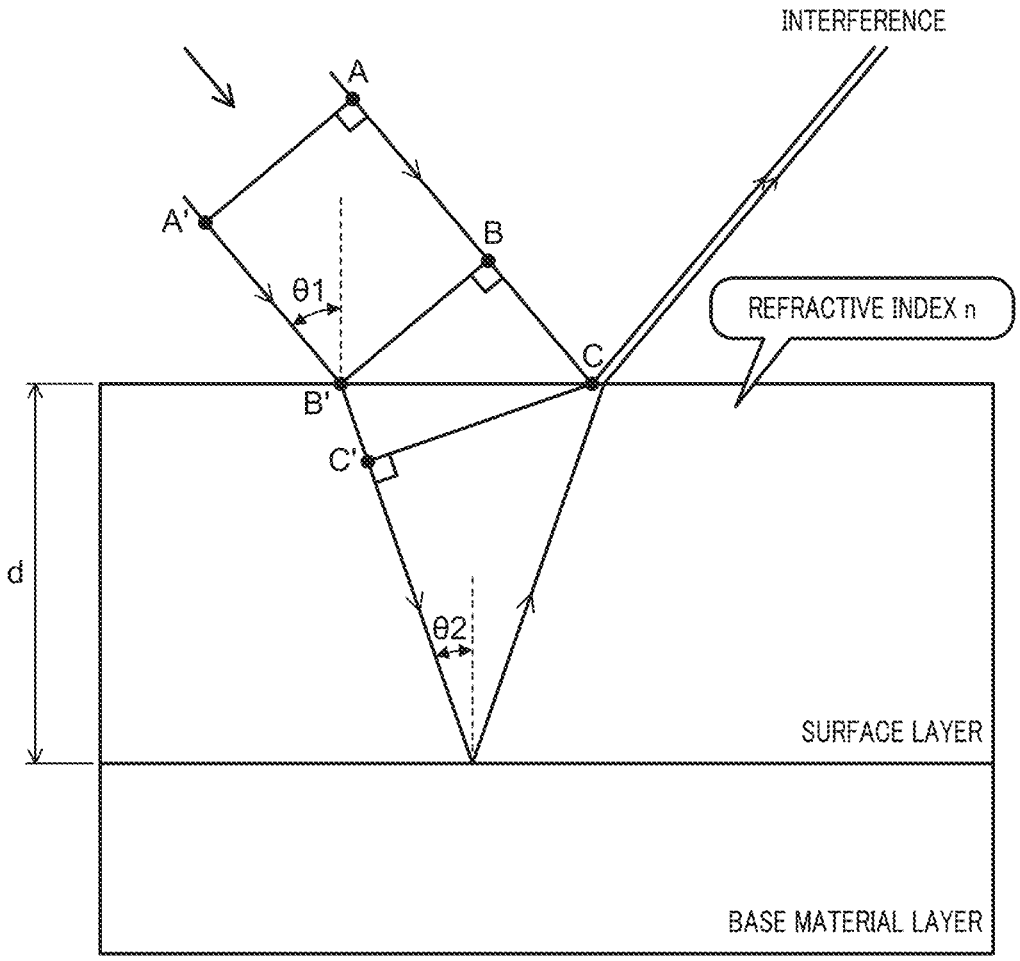
FIG. 1 is a diagram for illustrating a mechanism by which a sensor output fluctuates.
Figure 2:
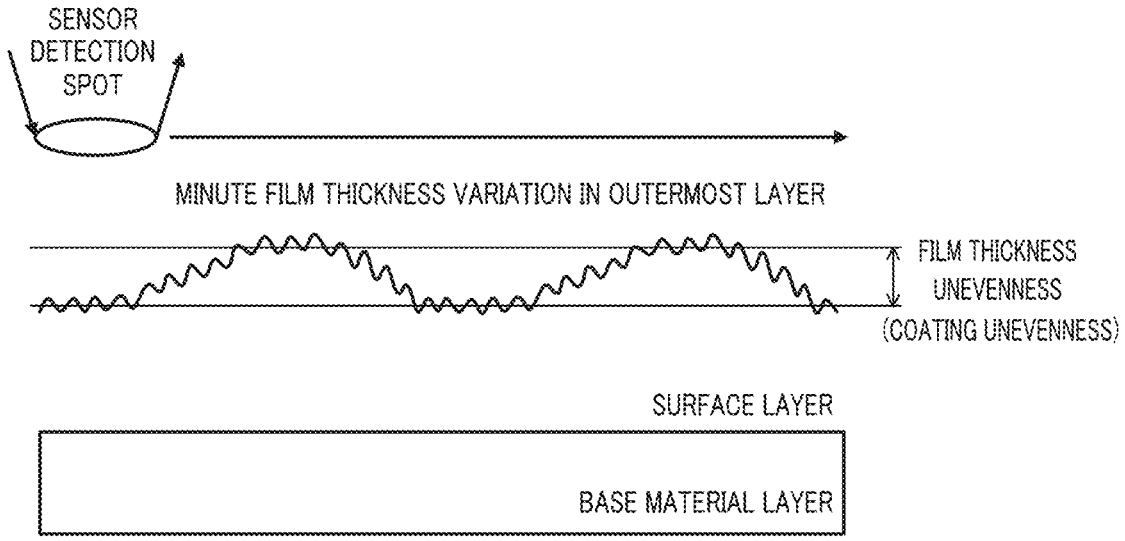
FIG. 2 is a diagram for illustrating an outermost layer state of an intermediate transfer belt.
Figure 3:
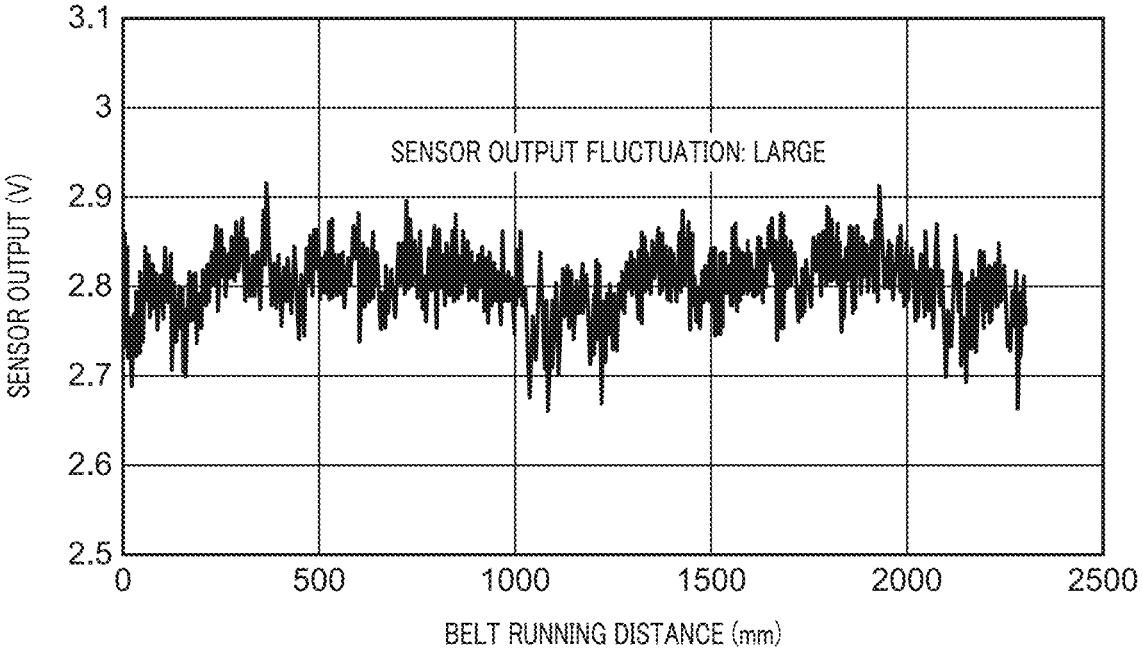
FIG. 3 is a chart illustrating a relationship between a belt running distance and a sensor output.
Figure 4:
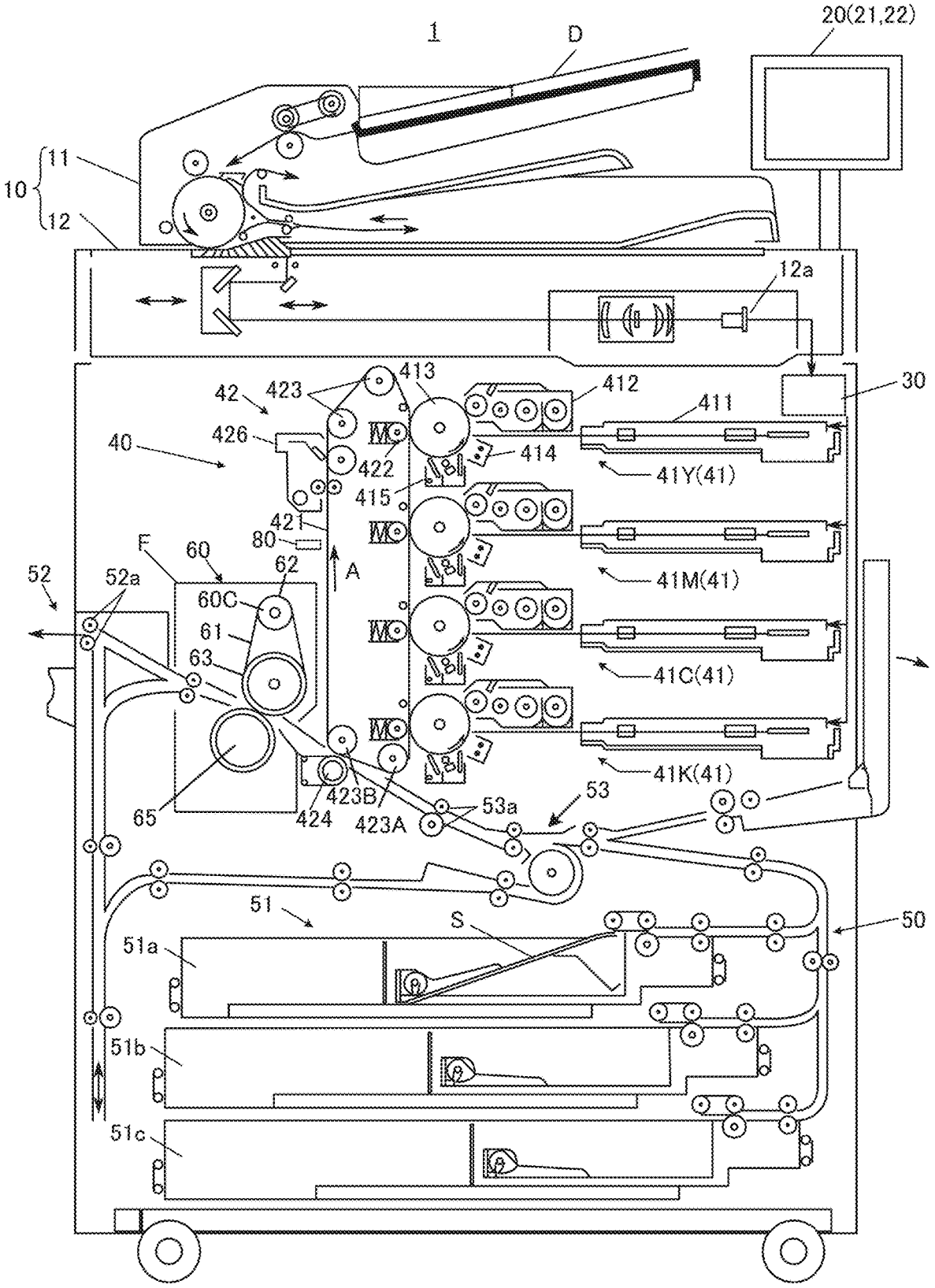
FIG. 4 is a diagram schematically illustrating an image forming apparatus according to an embodiment of the present invention.
Figure 5:
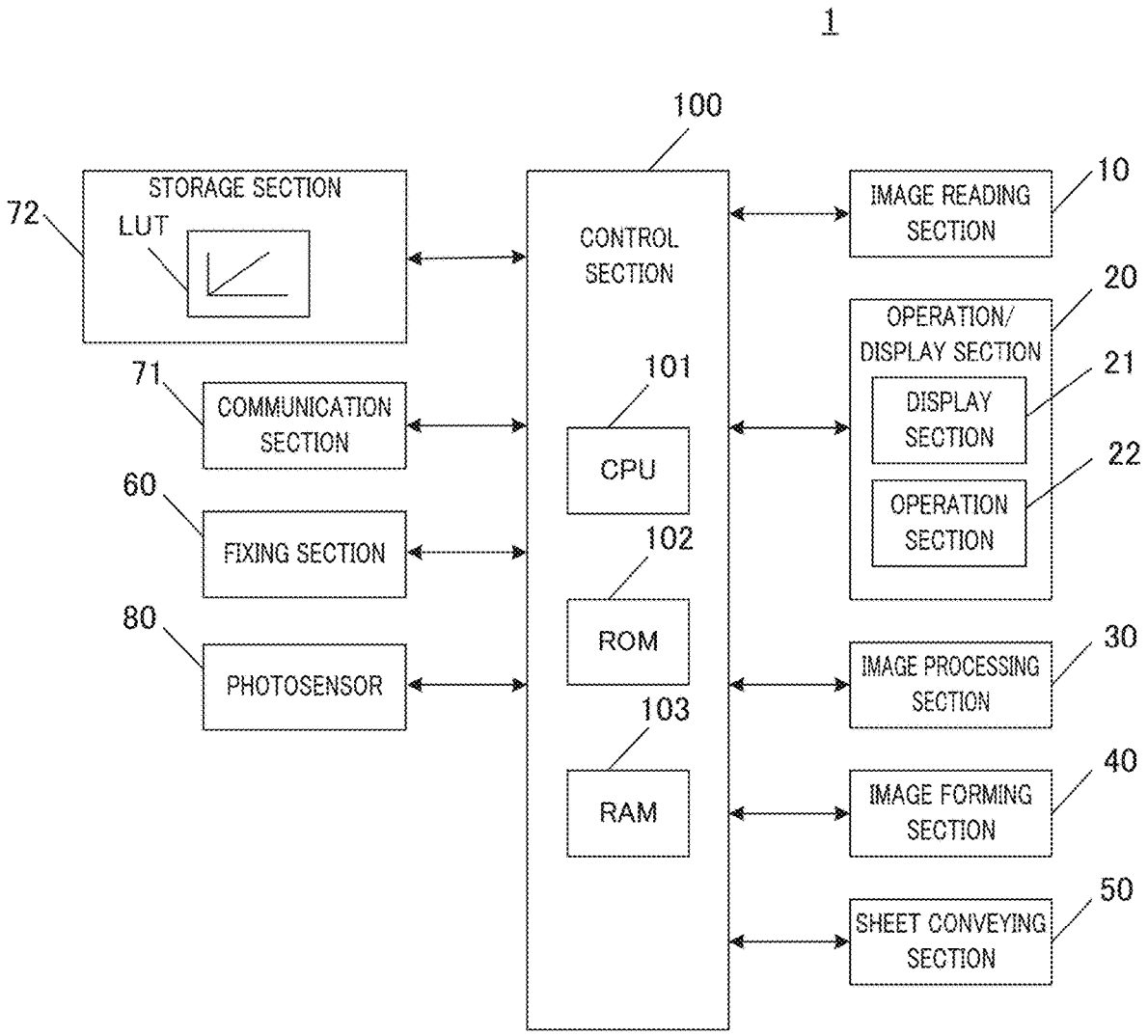
FIG. 5 is a diagram illustrating a main section of a control system of the image forming apparatus according to the present embodiment.

Hereinafter, the present embodiment will be described in detail with reference to the accompanying drawings. FIG. 4 is a diagram schematically illustrating an entire configuration of image forming apparatus 1 according to an embodiment of the present invention. FIG. 5 is a diagram illustrating a main section of a control system of image forming apparatus 1 according to the present embodiment. Image forming apparatus 1 illustrated in FIG. 4 and FIG. 5 is a color image forming apparatus of an intermediate transfer system using a technique of the electrophotographic process. That is, image forming apparatus 1 transfers respective color toner images of yellow (Y), magenta (M), cyan (C), and black (K) formed on photoconductor drums 413 to intermediate transfer belt 421 (primary transfer), superimposes the toner images of the four colors on intermediate transfer belt 421, and transfers it to sheet S (recording medium), thereby forming an image (secondary transfer).

In addition, image forming apparatus 1 employs a tandem system in which photoconductor drums 413 corresponding to the four colors of Y, M, C, and K are disposed in series in the running direction of intermediate transfer belt 421, and the toner images of the respective colors are successively transferred to intermediate transfer belt 421 in a single procedure.

As illustrated in FIG. 5, image forming apparatus 1 includes image reading section 10, operation/display section 20, image processing section 30, image forming section 40, sheet conveying section 50, fixing section 60, photosensor 80, and control section 100.

Control section 100 includes central processing unit (CPU) 101, read-only memory (ROM) 102, random access memory (RAM) 103, and the like. CPU 101 reads, from ROM 102, a program corresponding to processing details, loads the program into RAM 103, and performs, in cooperation with the loaded program, centralized control on operations of respective blocks of image forming apparatus 1. During this step, various data stored in storage section 72 are referred to. Storage section 72 includes, for example, a nonvolatile semiconductor memory (what is called flash memory) and/or a hard disk drive.

Control section 100 transmits/receives, via communication section 71, various data to/from an external device (e.g., personal computer) connected to a communication network such as a local area network (LAN) and a wide area network (WAN). For example, control section 100 receives image data (input image data) transmitted from the external device, and operates to form an image on sheet S on the basis of the image data. Communication section 71 includes, for example, a network interface card such as a LAN card.

Image reading section 10 includes auto document feeder (ADF) 11, document image scanner 12, and the like.

Auto document feeder 11 conveys, with a conveying mechanism, document D placed on a document tray and sends it to document image scanner 12. Images on multiple documents D (including images on both sides thereof) placed on the document tray can be continuously and simultaneously read using auto document feeder 11.

Document image scanner 12 optically scans a document conveyed from auto document feeder 11 onto a contact glass or a document placed on a contact glass, and images light reflected from the document on a light receiving surface of charge coupled device (CCD) sensor 12*a*, thereby reading a document image. Image reading section 10 generates input image data on the basis of a result of the reading performed by document image scanner 12. The input image data is subject to predetermined image processing in image processing section 30.

Operation/display section 20 includes, for example, a touch panel-type liquid crystal display (LCD), and functions as display section 21 and operation section 22. Display section 21 displays various operation screens, image conditions, operation conditions of each function, and the like in accordance with a display control signal input from control section 100. Operation section 22 includes various operation keys such as a numeric key pad and a start key, receives various input operation from a user, and outputs an operation signal to control section 100.

Image processing section 30 includes, for example, a circuit that performs digital image processing on input image data in accordance with default settings or user settings. For example, image processing section 30 performs tone correction on the basis of tone correction data (tone correction table) under the control of control section 100. In addition to the tone correction, image processing section 30 also performs, on the input image data, various correction processing such as color correction and shading correction, compression processing, and the like. Image forming section 40 is controlled on the basis of the processed image data.

Image forming section 40 includes, for example, intermediate transfer unit 42 and image forming units 41Y, 41M, 41C, and 41K for forming images with color toners of respective Y, M, C, and K components on the basis of the input image data.

Image forming units 41Y, 41M, 41C, and 41K for respective Y, M, C, and K components have similar configurations. For convenience in illustration and description, common components are denoted by the same numerals, and such numerals are accompanied by Y, M, C, or K when they are to be distinguished. In FIG. 4, only constituent elements of image forming unit 41Y for the Y component are denoted by numerals, and numerals for constituent elements of other image forming units 41M, 41C, and 41K are omitted.

Image forming unit 41 includes exposing device 411, developing device 412, photoconductor drum 413, charging device 414, drum cleaning device 415, and the like.

Photoconductor drum 413 is, for example, a negative-charging organic photoconductor (OPC) formed by successively laminating, on a peripheral surface of aluminum conductive cylinder (aluminum tube) having a drum diameter of 80 [mm], an undercoat layer (UCL), a charge generation layer (CGL), and a charge transport layer (CTL). The charge generation layer is formed from an organic semiconductor composed of a charge generation material (e.g., phthalocyanine pigment) dispersed in a resin binder (e.g., polycarbonate), and generates pairs of positive charges and negative charges upon exposure using exposing device 411. The charge transport layer is formed from a hole transport material (electron-donating nitrogen compound) dispersed in a resin binder (e.g., polycarbonate resin), and transports positive charges generated in the charge generation layer to a surface of the charge transport layer.

Control section 100 controls driving current supplied to a driving motor (not illustrated) that rotates photoconductor drum 413, thereby causing photoconductor drum 413 to rotate at a constant peripheral speed.

Charging device 414 evenly and negatively charges the surface of photoconductive photoconductor drum 413. Exposing device 411 includes, for example, a semiconductor laser, and irradiates photoconductor drum 413 with laser light corresponding to an image of each color component. Positive charges are generated in the charge generation layer of photoconductor drum 413, and transported to the surface of the charge transport layer, thereby neutralizing surface charges (negative charges) of photoconductor drum 413. Electrostatic latent images of respective color components are formed on the surface of photoconductor drums 413, respectively, due to potential differences from the surroundings.

A corona discharger that evenly and negatively charges the surface of photoconductor drum 413 by corona discharging is used as charging device 414. Charging device 414 includes a charging wire and a shield electrode. The charging wire is disposed along the width direction (longitudinal direction) of photoconductor drum 413. By supplying a high voltage to the charging wire, corona discharging is generated between the charging wire and the shield electrode surrounding the charging wire, thereby uniformly charging the surface of photoconductor drum 413 disposed to face the shield electrode.

Developing device 412 is a developing device of a two-component developing system, and forms a toner image by attaching a toner of each color component to the surface of each photoconductor drum 413 to visualize the electrostatic latent image.

Drum cleaning device 415 includes a drum cleaning blade and the like to be in sliding contact with the surface of photoconductor drum 413, and removes residual toner remaining on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is formed of an endless belt, and looped around the plurality of support rollers 423 under tension. At least one of the plurality of support rollers 423 is a driving roller, and the rest are driven rollers. For example, roller 423A, which is disposed downstream of primary transfer roller 422 for the K component in the running direction of the belt, is preferably a driving roller. This facilitates the retention of a constant running speed of the belt in a primary transfer section. Intermediate transfer belt 421 runs at a constant speed in the direction of an arrow A by driving roller 423A being rotated.

Intermediate transfer belt 421 is a belt having conductivity and elasticity, which includes a high resistance layer having a volume resistivity of 8 to 11 [log Ω·cm] on the surface thereof. Intermediate transfer belt 421 is rotationally driven by a control signal from control section 100. Note that a material, thickness, and hardness of intermediate transfer belt 421 are not limited as long as they have conductivity and elasticity.

Specifically, intermediate transfer belt 421 has a layered structure including a base material layer and a surface layer. The base material layer is formed of a synthetic resin in which a conductive material or the like is dispersed. The base material layer may have a single-layered structure or a multi-layered structure of two or more layers. Examples of the synthetic resin include a polyimide, polyamide-imide, polyphenylene sulfide, polyamide, and mixture thereof. Examples of a silicon oxide containing an alkyl group forming the surface layer include a siloxane compound such as a methyltrimethoxysilane, dimethyldimethoxysilane, phenyltrimethoxysilane, and methyltriethoxysilane. A silane coupling agent or other publicly known materials may be used as the siloxane compound.

Primary transfer roller 422 is disposed facing photoconductor drum 413 for each color component on the inner peripheral surface side of intermediate transfer belt 421. A primary transfer nip, which is for transferring a toner image from photoconductor drum 413 to intermediate transfer belt 421, is formed by firmly pressing primary transfer roller 422 onto photoconductor drum 413 with intermediate transfer belt 421 interposed therebetween.

Secondary transfer roller 424 is disposed on the outer peripheral surface side of intermediate transfer belt 421 while facing backup roller 423B disposed downstream of driving roller 423A in the running direction of the belt. A secondary transfer nip, which is for transferring a toner image from intermediate transfer belt 421 to sheet S, is formed by firmly pressing secondary transfer roller 424 onto backup roller 423B with intermediate transfer belt 421 interposed therebetween. A secondary transfer belt is looped around a plurality of support rollers including secondary transfer roller 424 under tension.

When intermediate transfer belt 421 passes through the primary transfer nip, toner images on photoconductor drums 413 are successively superimposed and transferred to intermediate transfer belt 421 (primary transfer). Specifically, primary transfer bias is applied to primary transfer roller 422 to impart a charge with polarity opposite to that of toners to the rear surface side of intermediate transfer belt 421 (side in contact with primary transfer roller 422), thereby electrostatically transferring the toner image to intermediate transfer belt 421.

Subsequently, when sheet S passes though the secondary transfer nip, the toner image on intermediate transfer belt 421 is transferred to sheet S (secondary transfer). Specifically, secondary transfer bias is applied to secondary transfer roller 424 to impart a charge with polarity opposite to that of toners to the rear surface side of sheet S (side in contact with secondary transfer roller 424), thereby electrostatically transferring the toner image to sheet S. Sheet S bearing the transferred toner image is conveyed to fixing section 60.

Photosensor 80 is disposed to face the surface of the surface layer of intermediate transfer belt 421. Photosensor 80 is, for example, a concentration sensor (IDC sensor) for detecting concentration of a test pattern (patch image) formed on intermediate transfer belt 421 for image stabilization. Photosensor 80 irradiates the surface layer of intermediate transfer belt 421 with detection light, and receives reflected light of the detection light reflected from the surface layer of intermediate transfer belt 421. Details of photosensor 80 will be described later.

Belt cleaning device 426 includes a belt cleaning blade and the like to be in sliding contact with the surface of intermediate transfer belt 421, and removes residual toner remaining on the surface of intermediate transfer belt 421 after the secondary transfer.

Fixing section 60 includes fixing belt 61, heating roller 62, upper-side pressure roller 63 disposed on a fixing surface (surface on which the toner image is formed) of sheet S, lower-side pressure roller 65 disposed on the rear surface (surface opposite to the fixing surface) of sheet S, heat source 60C, and the like. Heating roller 62 incorporates heating source 60C that heats fixing belt 61. A fixing nip that grips and conveys sheet S is formed by firmly pressing lower-side pressure roller 65 onto upper-side pressure roller 63.

Fixing section 60 heats and presses the conveyed sheet S on which the toner image has been transferred (secondary transfer) at the fixing nip, thereby fixing the toner image on sheet S. Fixing section 60 is disposed inside fixing device F as a unit.

Sheet conveying section 50 includes sheet feeding section 51, sheet ejection section 52, conveying path section 53, and the like. Three sheet feed tray units 51*a* to 51*c* included in sheet feeding section 51 store sheets S (standard sheet or special sheet) classified on the basis of weight, size, and the like in accordance with predetermined types. Conveying path section 53 includes a plurality of pairs of conveyance rollers including registration roller pair 53*a*.

Sheets S stored in sheet feed tray units 51*a* to 51*c* are sent out from the topmost part one by one, and conveyed to image forming section 40 through conveying path section 53. During this step, a registration roller section in which registration roller pair 53*a* is disposed corrects the tilt of sheet S having been fed and adjusts the timing of conveyance. The toner image on intermediate transfer belt 421 is then simultaneously transferred to one of the surfaces of sheet S in image forming section 40 (secondary transfer), and a fixing step is performed in fixing section 60. Sheet S bearing the formed image is ejected outside the apparatus by sheet ejection section 52 provided with sheet ejection roller 52*a*.

Meanwhile, in image forming apparatus 1, the surface layer of intermediate transfer belt 421 has surface roughness of the outermost layer and variation in film thickness of the surface layer. Accordingly, interference fringes included in the reflected light of the detection light reflected from the surface layer varies. Therefore, a reflected light amount (output of photosensor 80) fluctuates. As a result, accuracy of image stabilization control may be lowered. In the following descriptions, the surface roughness of the outermost layer of the surface layer of intermediate transfer belt 421 may be simply referred to as "surface roughness". Further, the film thickness of the surface layer of intermediate transfer belt 421 may be simply referred to as "film thickness".

Figure 6A:
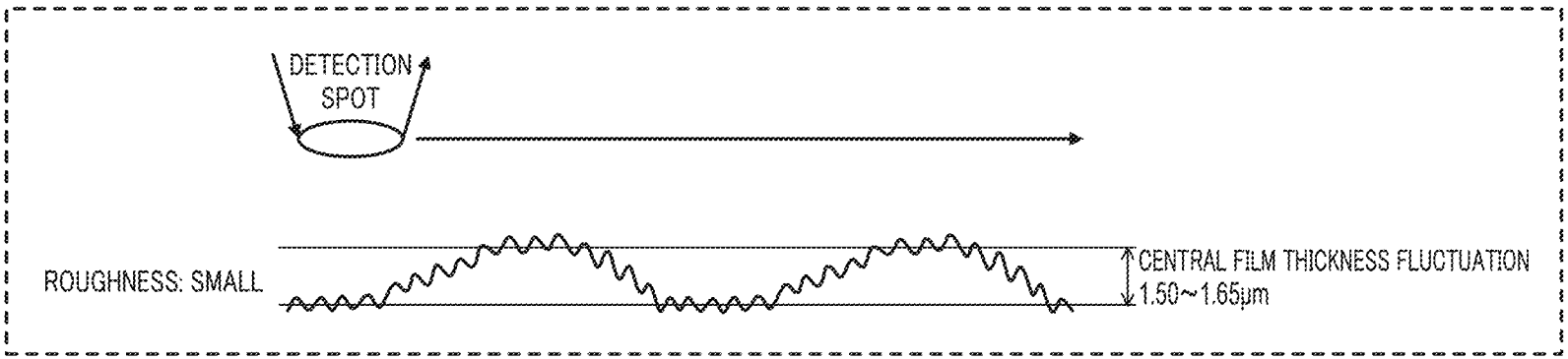
FIG. 6A is a diagram illustrating a case where surface roughness of an outermost layer of a surface layer of the intermediate transfer belt is large.
Figure 6B:
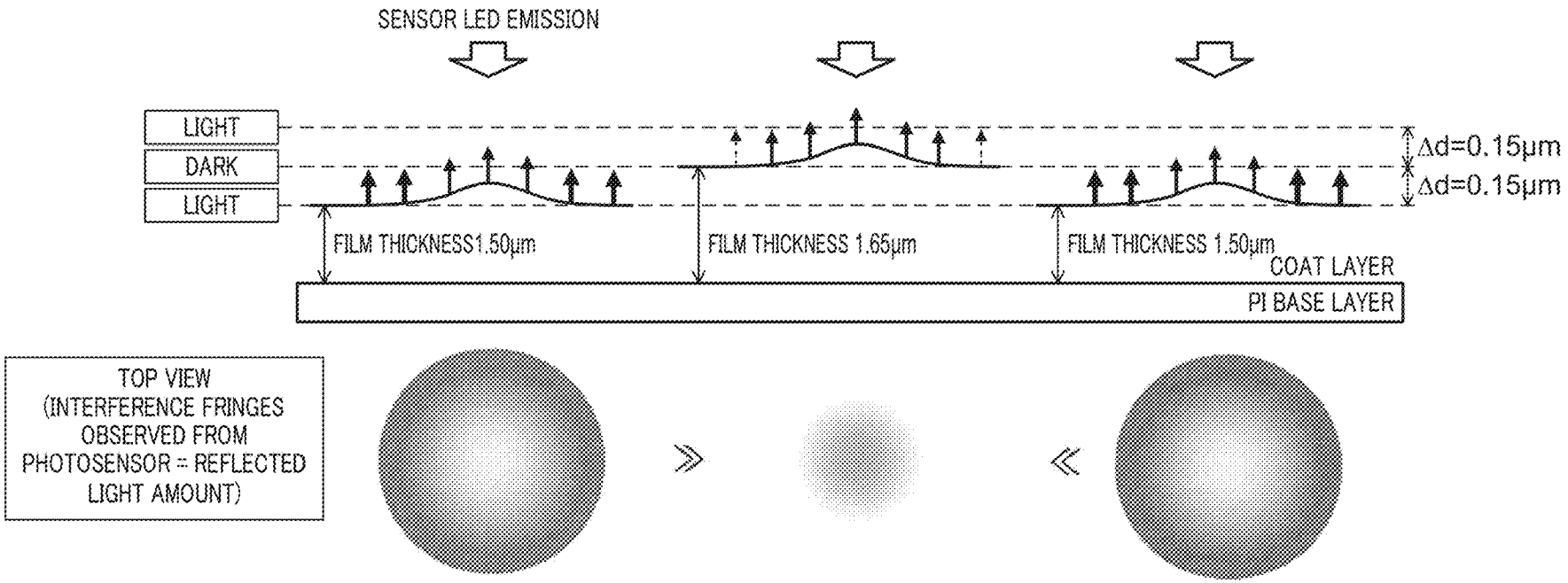
FIG. 6B is a diagram illustrating a relationship between a film thickness of the surface layer of the intermediate transfer belt and interference fringes, and also illustrating the interference fringes observed from a photosensor.

FIG. 6A is a diagram illustrating a case where the surface roughness is small. FIG. 6B is a diagram illustrating a relationship between the film thickness and the interference fringes, and also illustrating the interference fringes observed from photosensor 80. In FIG. 6A, the horizontal axis represents a position of a detection range (detection spot) of photosensor 80, and the vertical axis represents surface roughness and a central film thickness. In FIG. 6B, the horizontal axis represents a position of an enlarged detection range, and the vertical axis represents film thickness difference $\Delta d$. When it is assumed that dominant wavelength $\lambda P$ of photosensor 80 is 870 nm and the incident angle of the detection light emitted onto the surface layer of intermediate transfer belt 421 is zero degree (vertical), film thickness difference $\Delta d$ between the film thickness of a case where the light interference is included in the reflected light and the film thickness of a case where the dark interference is included in the reflected light is 0.15 μm.

As illustrated in FIG. 6B, in a case where film thickness difference $\Delta d$ is less than 0.15 m, the change in reflected light amount (interference fringes) between the positions of the detection range is large. Specifically, there are a detection range in which the light interference is included in the reflected light while the dark interference is not included therein (detection range with a film thickness of 1.50 μm), and a detection range in which the dark interference is included in the reflected light while the light interference is not included therein (detection range with a film thickness of 1.65 μm). The reflected light amount of the case where the light interference is included in the reflected light while the dark interference is not included therein is large. The reflected light amount of the case where the dark interference is included in the reflected light while the light interference is not included therein is small. That is, the change in reflected light amount between the positions of the detection range is large. In this manner, in the case where the change in reflected light amount between the positions of the detection range is large, the accuracy of the image stabilization control performed on the basis of the output of photosensor 80 may be lowered.

Figure 7A:
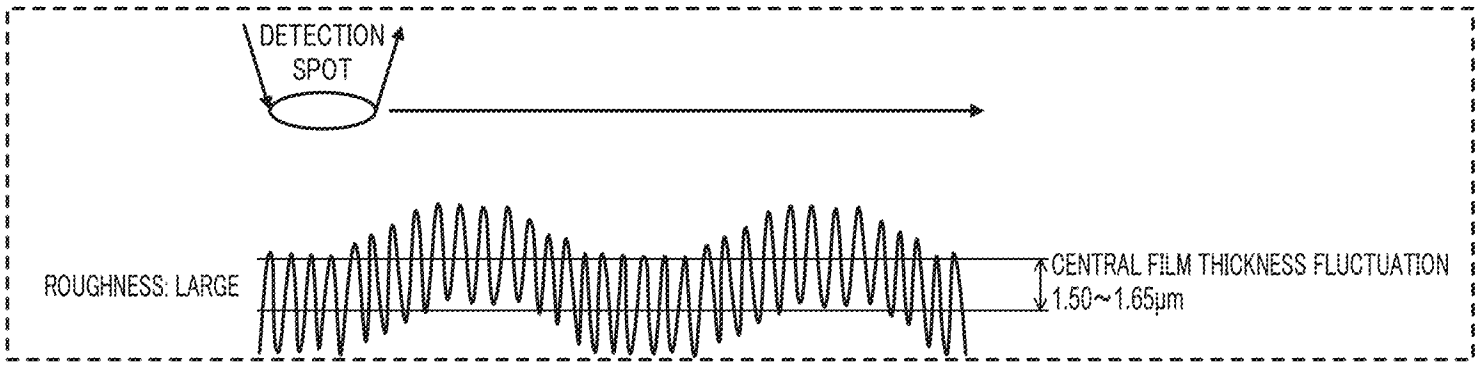
FIG. 7A is another diagram illustrating the case where the surface roughness of the outermost layer of the surface layer of the intermediate transfer belt is large.
Figure 7B:
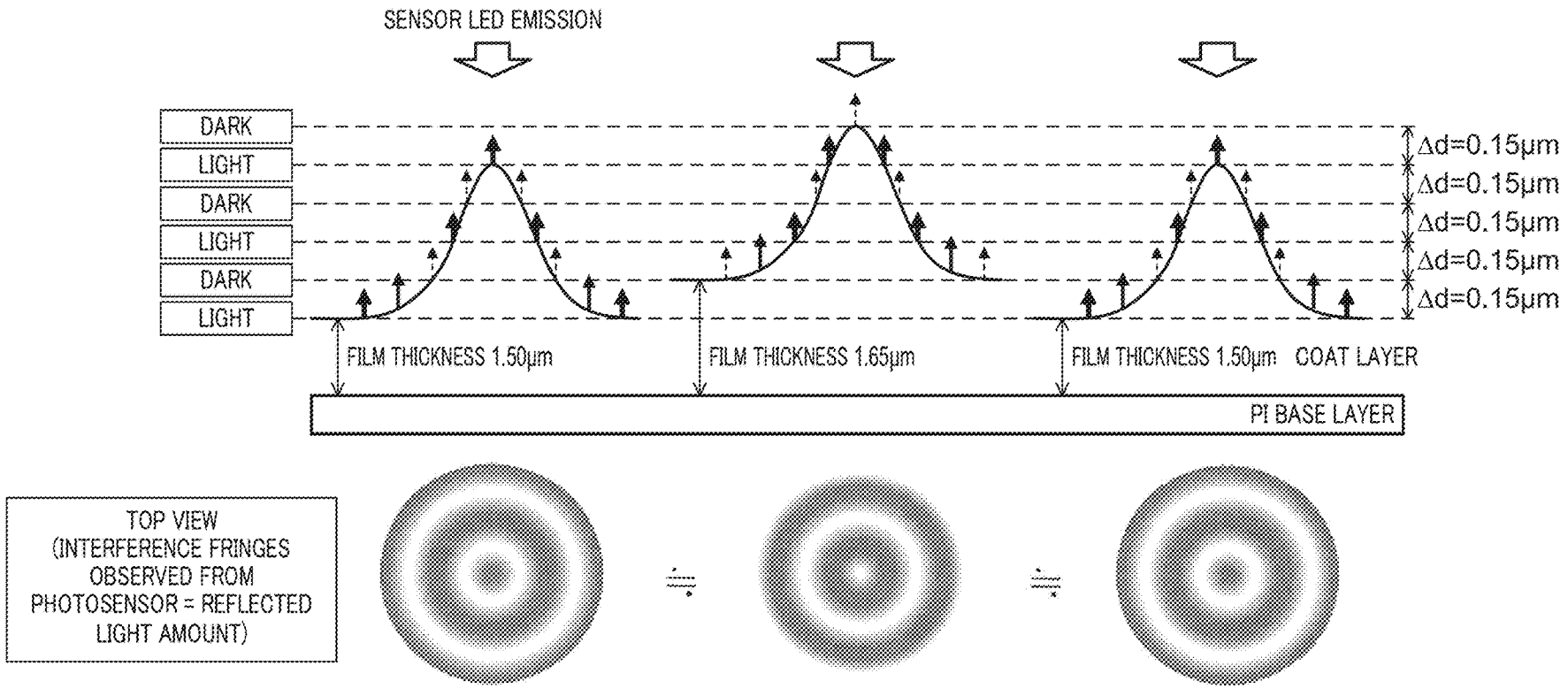
FIG. 7B is another diagram illustrating the relationship between the film thickness of the surface layer of the intermediate transfer belt and the interference fringes, and also illustrating the interference fringes observed from the photosensor.

FIG. 7A is a diagram illustrating a case where the surface roughness is large. FIG. 7B is a diagram illustrating the relationship between the film thickness and the interference fringes, and also illustrating the interference fringes observed from photosensor 80. In FIG. 7A, the horizontal axis represents the position of the detection range (detection spot) of photosensor 80, and the vertical axis represents the surface roughness and the central film thickness. In FIG. 7B, the horizontal axis represents the position of the enlarged detection range, and the vertical axis represents the film thickness difference Δd. Note that the precondition for the case where the surface roughness is small and the precondition for the case where the surface roughness is large mentioned above is the same.

As illustrated in FIG. 7B, in a case where film thickness difference Δd is 0.15 μm or more, the change in reflected light amount (interference fringes) between the positions of the detection range is small. Specifically, there are a detection range in which three spots of the light interference and two spots of the dark interference are included in the reflected light (detection range with the film thickness of 1.50 μm), and a detection range in which two spots of the light interference and three spots of the dark interference are included in the reflected light (detection range with the film thickness of 1.65 μm). The reflected light amount in both detection ranges is an averaged light amount including both of the light interference and the dark interference. That is, the change in reflected light amount between the positions of the detection range is small. In this manner, in the case where the change in reflected light amount between the positions of the detection range is small, the accuracy of the image stabilization control performed on the basis of the output of photosensor 80 is improved.

In view of the above, in the present embodiment, in order to suppress the change in reflected light amount between the positions of the detection range, optical interference is positively generated so that the light interference and the dark interference are included in the detection range and the reflected light amount is averaged, thereby suppressing the change in reflected light amount.

Figure 8:
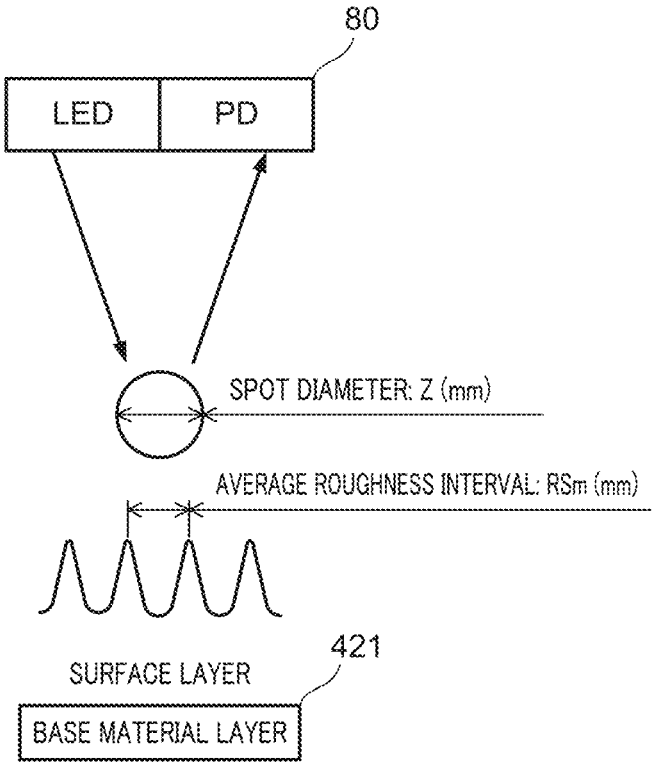
FIG. 8 is a diagram schematically illustrating the photosensor.

FIG. 8 is a diagram schematically illustrating photosensor 80. Photosensor 80 irradiates, on the basis of a predetermined detection condition, the surface layer of intermediate transfer belt 421 with detection light, and receives reflected light of the detection light reflected from the surface layer of intermediate transfer belt 421. Specifically, photosensor 80 detects the reflection intensity of the test pattern (patch image) formed on the surface layer of intermediate transfer belt 421.

As illustrated in FIG. 8, photosensor 80 includes, for example, a light-emitting element such as a light-emitting diode (LED), and a light receiving element such as a photodiode (PD). The light-emitting element irradiates the detection range on the surface layer of intermediate transfer belt 421 with the detection light. The light receiving element receives the reflected light of the detection light reflected from the surface layer.

Control section 100 controls the detection condition such that the reflected light received by photosensor 80 includes the light interference and the dark interference. Specifically, control section 100 controls dominant wavelength λp of photosensor 80 according to the surface roughness, and also performs control such that spot diameter Z of the detection range is set to be larger than the interval of the surface roughness (in this case, average roughness interval RSm [mm]). For the surface roughness, for example, inspection data at the time of manufacturing or shipping intermediate transfer belt 421 or data measured by a general-purpose surface roughness measuring device is used.

Figure 9:
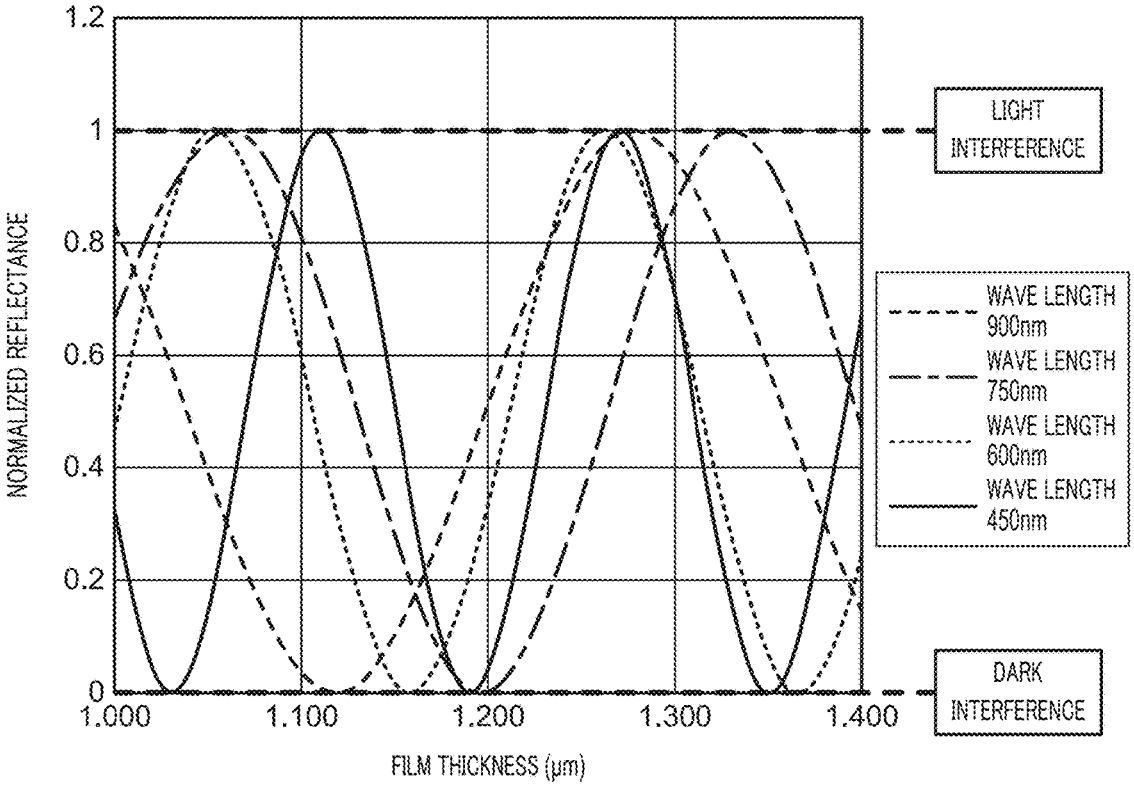
FIG. 9 is a chart illustrating a relationship between the film thickness and normalized reflectance.

FIG. 9 is a chart illustrating a relationship between the film thickness and normalized reflectance. In FIG. 9, the horizontal axis represents the film thickness, and the vertical axis represents the normalized reflectance. In the following descriptions, the incident angle of the detection light emitted onto the surface layer of intermediate transfer belt 421 is set to 20 degrees (zero degree when it is vertical), and a refractive index of the surface layer is set to 1.46 (at a wavelength of 550 nm), which is the refractive index of the silicon oxide $SiO_2$ that is the main component.

As illustrated in FIG. 9, in a case where dominant wavelength λp of photosensor 80 is 900 nm, the film thickness at the time of indicating the light interference (light interference film thickness) is 1.275 μm, and the film thickness at the time of indicating the dark interference (dark interference film thickness) is 1.120 μm. Accordingly, the film thickness difference Δd between the light interference film thickness and the dark interference film thickness is 0.155 μm (=1.275-1.120).

In a case where dominant wavelength λp is 750 nm, the light interference film thickness is 1.330 μm, and the dark interference film thickness is 1.195 μm. Accordingly, film thickness difference Δd is 0.135 μm (=1.330-1.195).

In a case where dominant wavelength λp is 600 nm, the light interference film thickness is 1.265 μm, and the dark interference film thickness is 1.158 μm. Accordingly, film thickness difference Δd is 0.107 μm (=1.265-1.158).

In a case where dominant wavelength λp is 450 nm, the light interference film thickness is 1.270 μm, and the dark interference film thickness is 1.188 μm. Accordingly, film thickness difference Δd is 0.082 μm (=1.270-1.188).

As described above, film thickness difference Δd differs depending on dominant wavelength λp. Film thickness difference Δd decreases as dominant wavelength λp decreases.

Figure 10:
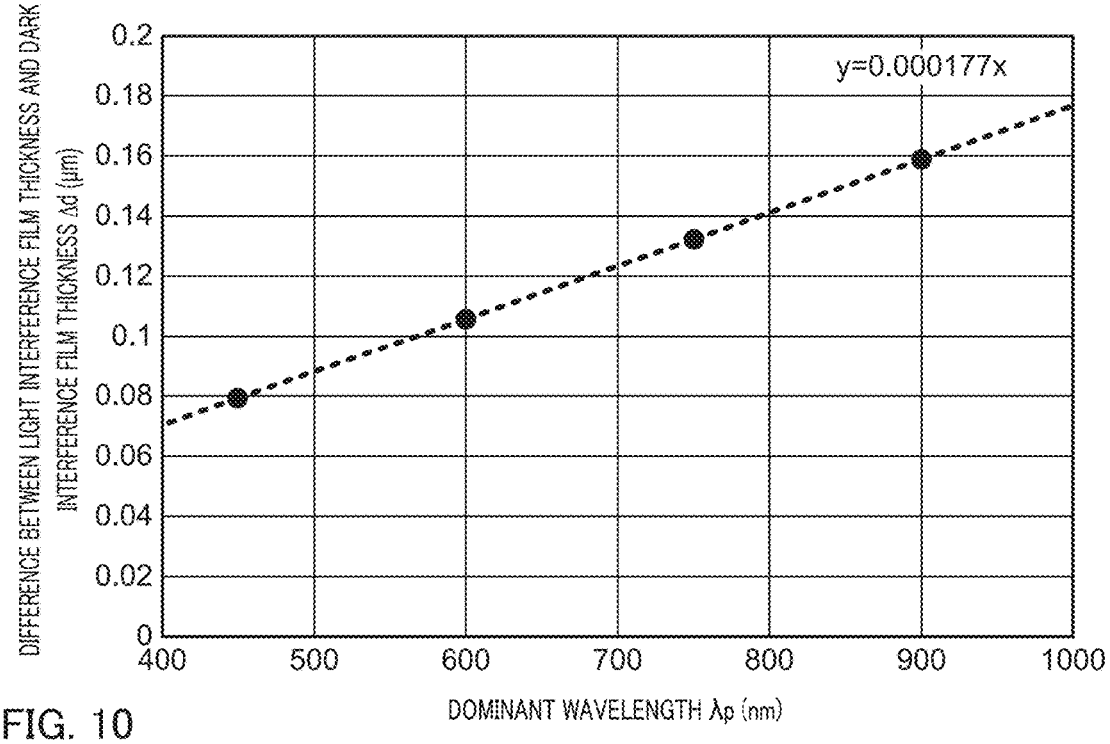
FIG. 10 is a chart illustrating a relationship between a dominant wavelength and a film thickness difference.

FIG. 10 is a chart illustrating a relationship between dominant wavelength λp and film thickness difference Δd. In FIG. 10, the horizontal axis x represents dominant wavelength λp [nm], and the vertical axis y represents film thickness difference Δd [μm]. FIG. 10 illustrates the above-described four points of data plotted on the xy coordinates (e.g., dominant wavelength λp=900 nm and film thickness difference Δd=0.155 μm). A relational expression between dominant wavelength λp and film thickness difference Δd is obtained by linearly approximating the four points of data using the method of least squares or the like. The relational expression is expressed by the following formula (3).

$$y=0.000177x \tag{3}$$

When dominant wavelength λp and film thickness difference Δd satisfy formula (3), it is indicated that the reflected light received by photosensor 80 includes each one of the light interference and the dark interference.

In order to include one or more of the light interference and the dark interference in the reflected light, dominant wavelength λp of photosensor 80 that satisfies the following formula (4) may be set.

$$X>a*\Delta d(\lambda p) \tag{4}$$

Here, X is the surface roughness. The variable a is an arbitrary value of one or more. Besides, Δd(λp) is a film thickness difference that satisfies formula (3) mentioned above.

Examples of a parameter relating to the surface roughness include the ten-point average roughness (Rz), the maximum height roughness, the maximum peak height (Rp) of a roughness curve, the maximum root depth (Rv) of the roughness curve, the average height (Rc) of a roughness curve element, the maximum cross-sectional height (Rt) of the roughness curve, the arithmetic average roughness (Ra), and the root mean square surface roughness (Rq). In the present embodiment, the parameter is described using the ten-point average roughness (Rz).

For example, in a case where a=1 (each one of the light interference and the dark interference) and ten-point average roughness Rz=0.12 μm are satisfied, dominant wavelength λp at which film thickness difference Δd becomes 0.12 μm can be obtained from the formula (3) as 678 nm. If dominant wavelength λp is set to 678 nm or less, X(Rz)>Δd(λp) is satisfied.

The range of dominant wavelength λp is preferably 400 nm to 1,000 nm, more preferably 400 nm to 678 nm. Although the range of dominant wavelength λp is set for reasons such as cost, other wavelengths may be used if it becomes inexpensive in the future.

According to image forming apparatus 1 in the above embodiment, control section 100 controls the dominant wavelength of photosensor 80 such that the reflected light received by photosensor 80 includes the light interference and the dark interference. Accordingly, the reflected light amount is averaged, whereby the output fluctuation of photosensor 80 can be suppressed.

Moreover, according to the above embodiment, control section 100 performs control such that spot diameter Z of the detection range of photosensor 80 is set to be larger than average roughness interval RSm. Accordingly, the light interference and the dark interference can be included in the reflected light, whereby output of photosensor 80 can be stabilized. Specifically, in a case where average roughness interval RSm of the surface layer of intermediate transfer belt 421 is about 0.04 mm to 0.20 mm, stable reflected light can be detected using photosensor 80 having spot diameter Z of φ3.0 mm and photosensor 80 having spot diameter Z of φ2.5 mm even if variation in film thickness is generated.

Modified Example 1

Next, Modified Example 1 will be described. In order to further average a reflected light amount, it is preferable to equally include light interference and dark interference in reflected light.

In a case where the arbitrary value a in the above-mentioned formula (4) is positive integer N, the light interference and the dark interference are the same number and the same ratio (state A). In a case where the variable a deviates from integer N by half value (0.5), it enters a state in which either of the light interference or the dark interference is larger than the other, which is a deviated state (state B). In view of the above, the variable a is set to a state closer to state A than the middle point between state A and state B, that is, the variable s is set within the range deviated from integer N by 0.25 (=0.5/2). This is expressed by the following formula (5).

$$N-0.25 \le a \le N+0.25 \quad (5)$$

As described above, control section 100 according to Modified Example 1 controls dominant wavelength λp of photosensor 80 to satisfy formulae (4) and (5) mentioned above. Accordingly, the reflected light amount can be further averaged. As a result, output fluctuation of photosensor 80 can be further suppressed.

Modified Example 2

Next, Modified Example 2 will be described with reference to FIG. 11, FIG. 12, FIG. 13A and FIG. 13B. An output of photosensor 80 with respect to surface roughness is determined by experiment. Here, the surface roughness and an arbitrary value a are set to satisfy formula (4) mentioned above. Further, Δd(λp) in formula (4) is set to 0.15 μm.

The following evaluation result was obtained. FIG. 11 is a table illustrating the evaluation result of variation in output of photosensor 80 with respect to the surface roughness (ten-point average roughness Rz). The variation in output of photosensor 80 was evaluated by Vmax−Vmin at the time of detecting one circumferential length of intermediate transfer belt 421. As evaluation criteria, the case where the variation was suppressed to a certain extent was set to "C". The case where the variation was suppressed within an acceptable range was set to "B". The case where the variation was sufficiently suppressed was set to "A".

The following facts were found from the evaluation result illustrated in FIG. 11. In order to allow the variation in output of photosensor 80, it is necessary that the surface roughness is 0.2 μm or more, the arbitrary value a is 1.3 or more, and integer N is 2 or more. Furthermore, it is preferable that the surface roughness is 0.6 μm or more, the arbitrary value a is 3.8 or more, and integer N is 4 or more.

Dominant wavelength λp is set within a range from 400 nm to 1,000 nm for reasons such as cost as described above. Therefore, the upper limit of integer N is 8. Accordingly, integer N preferably satisfies the following formula (6).

$$4 \le N \le 8 \quad (6)$$

In the experiment by which the evaluation result illustrated in FIG. 11 was obtained, a plurality of types of surface roughness was set while Δd(λP) was set to be constant (=0.15 μm). Besides, the arbitrary value a corresponding to the surface roughness was set.

In the following experiment, a plurality of types of dominant wavelength λp was set while the surface roughness (ten-point average roughness Rz) was set to be constant (=0.6 μm). Besides, an arbitrary value a corresponding to the dominant wavelength λp was set.

The following evaluation result was obtained. FIG. 12 is a table illustrating the evaluation result of the variation in output of photosensor 80 in intermediate transfer belt 421 having surface roughness Rz of 0.6 μm. FIG. 12 illustrates dominant wavelength λp that satisfies the following formula (7) with respect to surface roughness Rz.

$$0.6 > a * \Delta d(\lambda p) \quad (7)$$

The arbitrary value a satisfies the following formula (8).

$$N-0.25 \le a \le N+0.25 (N \text{ is an integer of 1 to 8}) \quad (8)$$

The following facts were found from the evaluation result illustrated in FIG. 12. As evaluation criteria, the case where the variation was suppressed to a certain extent was set to "C". The case where the variation was suppressed within an acceptable range was set to "B". The case where the variation was sufficiently suppressed was set to "A". In a case where the surface roughness is 0.6 μm, in order to allow the variation in output of photosensor 80, it is necessary that the arbitrary value a is 1.75 or more, and integer N is 2 or more. Furthermore, it is preferable that the arbitrary value a is 3.75 or more, and integer N is 4 or more.

Figure 13A:
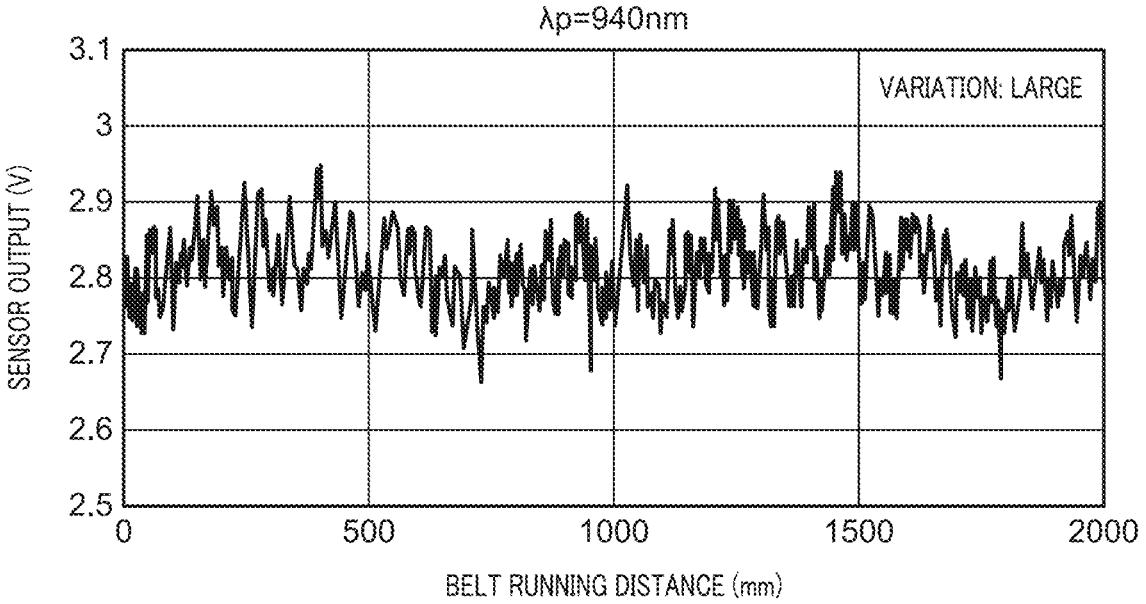
FIG. 13A is a chart illustrating the variation in output of the photosensor having a specific dominant wavelength.

Specifically, the variation in output of photosensor 80 in which dominant wavelength λp and the arbitrary value a were set was measured. FIG. 13A is a chart illustrating the variation in output of photosensor 80 having dominant wavelength λp of 940 nm (a=3.5). In FIG. 13A, the horizontal represents a belt running distance [mm], and the vertical axis represents a sensor output [V]. As illustrated in FIG. 13A, the variation range was 2.65 [V] to 2.95 [V], which was large. As a result, in a case where a film thickness of a surface layer varies, photosensor 80 failed to detect stable reflected light.

Figure 13B:
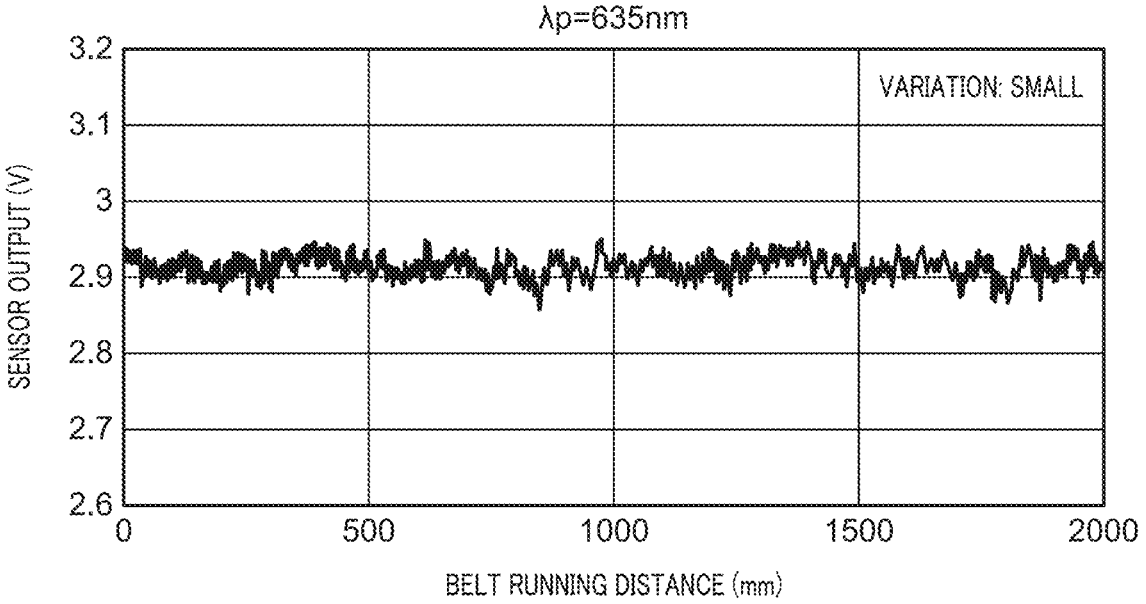
FIG. 13B is another chart illustrating the variation in output of the photosensor having a specific dominant wavelength.

FIG. 13B is a chart illustrating the variation in output of photosensor 80 having dominant wavelength λp of 635 nm (a=5.2). In FIG. 13B, the horizontal represents the belt running distance [mm], and the vertical axis represents the sensor output [V]. As illustrated in FIG. 13B, the variation range was 2.85 [V] to 2.95 [V], which was small. As a result, in the case where the film thickness of the surface layer varies, photosensor 80 succeeded in detecting stable reflected light. Although illustration is omitted, variation in output of photosensor 80 having dominant wavelength λp of 870 nm (a=3.8) was also measured. In this case as well, the variation range was small. As a result, in the case where the film thickness of the surface layer varies, photosensor 80 succeeded in detecting stable reflected light.

Modified Example 3

Figure 14:
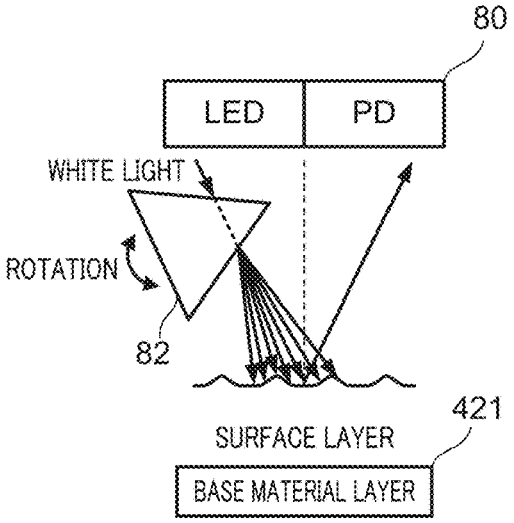
FIG. 14 is a diagram schematically illustrating a prism as a spectroscopic unit.
Figure 15:
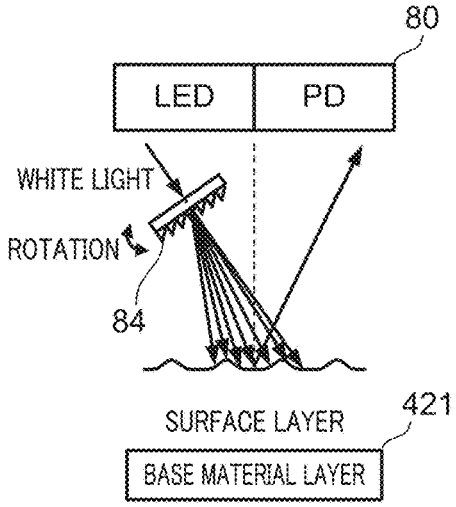
FIG. 15 is a diagram schematically illustrating a transmission type diffraction grating as a spectroscopic unit.

Next, Modified Example 3 will be described with reference to FIG. 14 and FIG. 15. Control section 100 selects dominant wavelength λp of photosensor 80 according to surface roughness.

Image forming apparatus 1 according to Modified Example 3 includes a spectroscopic unit that separates white light emitted from a light-emitting diode (LED) into a plurality of monochromatic light. FIG. 14 illustrates prism 82 as a spectroscopic unit. Prism 82 rotates such that a photodiode (PD) selectively receives the plurality of separated monochromatic light. Control section 100 determines dominant wavelength λp according to the surface roughness, and rotates prism 82 such that the photodiode (PD) receives light having a desired dominant wavelength. The spectroscopic unit is not limited to prism 82, and may be transmission type diffraction grating 84 as illustrated in FIG. 15, for example. Further, control section 100 may determine dominant wavelength λp on the basis of a table in which dominant wavelengths λp according to the surface roughness are summarized.

According to Modified Example 3, the spectroscopic unit is provided so that dominant wavelength λp according to the surface roughness can be selected from among a plurality of types of dominant wavelengths λp even with one photosensor 80.

Modified Example 4

Figure 16:
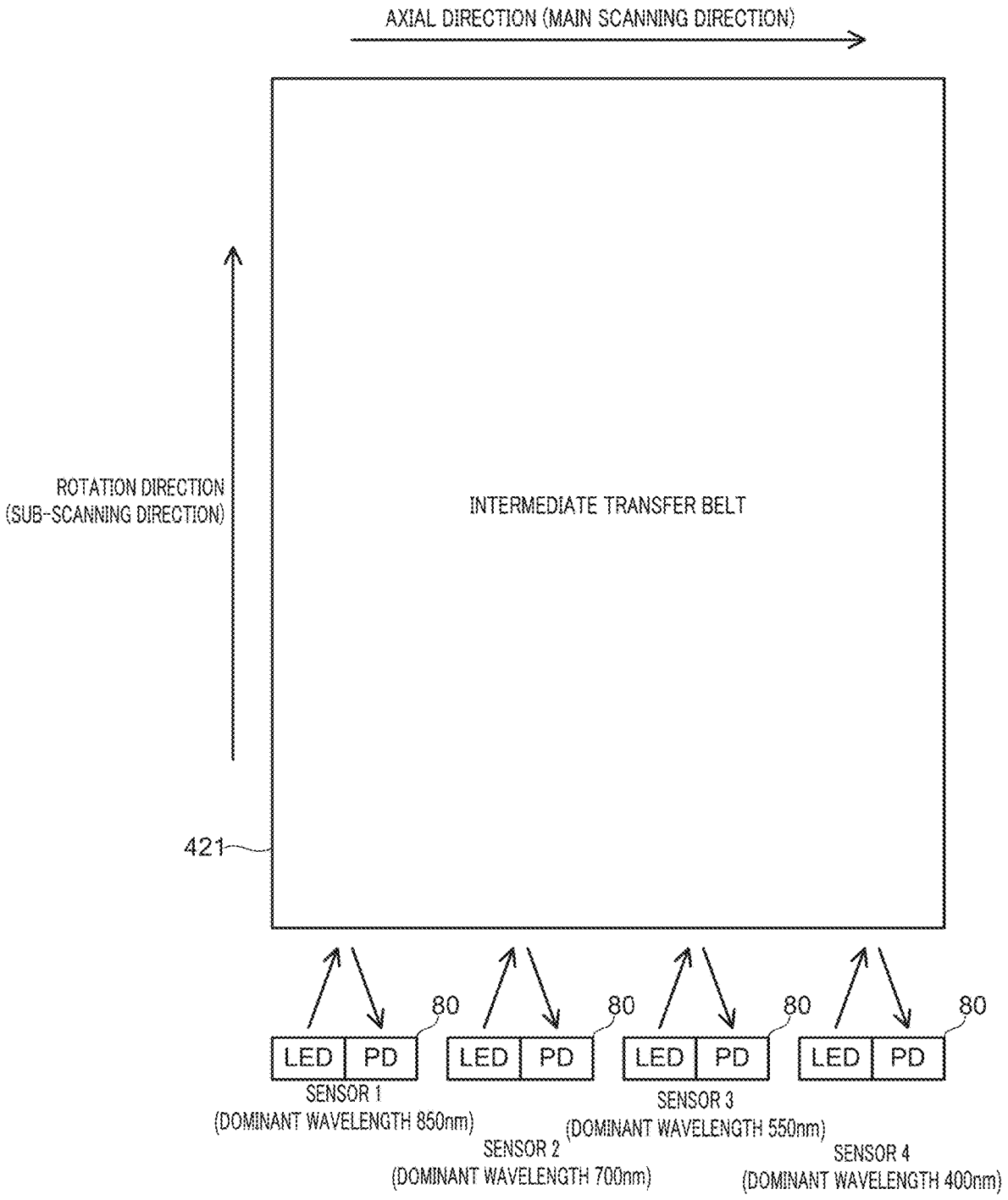
FIG. 16 is a diagram schematically illustrating a plurality of types of photosensors disposed in the axial direction of the intermediate transfer belt.

Next, Modified Example 4 will be described with reference to FIG. 16. In FIG. 16, the upper direction is a rotation direction (sub-scanning direction) of intermediate transfer belt 421, and the right-left direction is an axial direction (scanning direction) of intermediate transfer belt 421.

As illustrated in FIG. 16, a plurality of types of photosensors 80 are disposed in the axial direction. Here, dominant wavelength λp of each photosensor 80 is 850 nm, 700 nm, 550 nm, and 400 nm. Note that photosensor 80 may be disposed in the sub-scanning direction. Control section 100 determines dominant wavelength λp according to surface roughness, and selects photosensor 80 having the determined dominant wavelength 4p. Note that control section 100 may determine dominant wavelength λp on the basis of a table in which dominant wavelengths λp according to the surface roughness are summarized.

According to Modified Example 4, the plurality of types of photosensors 80 having dominant wavelengths λp different from each other are provided so that photosensor 80 having dominant wavelength λp according to the surface roughness can be selected from among the plurality of types of photosensors 80.

Modified Example 5

Next, Modified Example 5 will be described with reference to FIG. 17. In the above-described embodiment, control section 100 controls a diaphragm (not illustrated), for example, such that spot diameter Z of the detection range is set to be larger than the interval of the surface roughness (e.g., average roughness interval RSm) according to the surface roughness.

Figure 17:
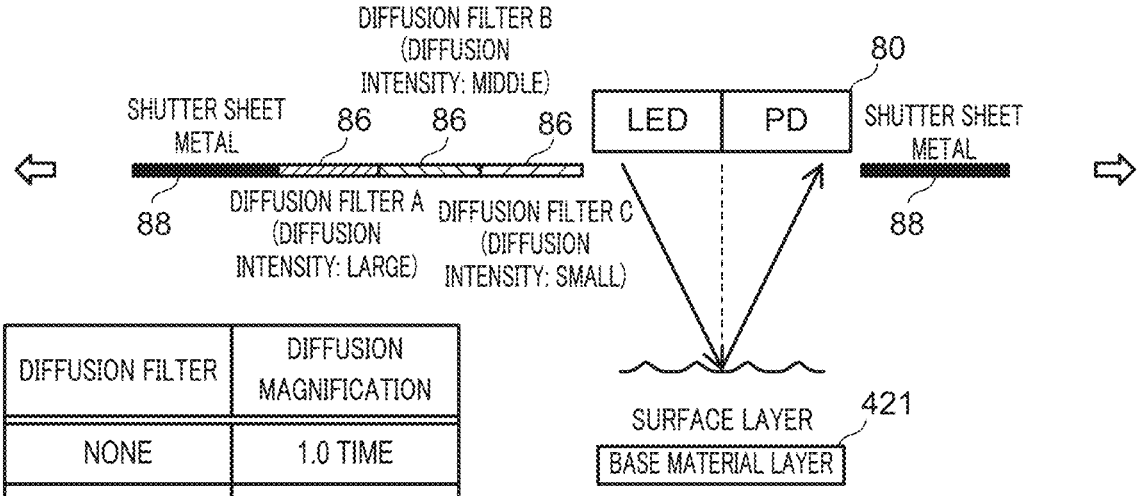
FIG. 17 is a diagram schematically illustrating a plurality of types of diffusion filters disposed along the surface layer of the intermediate transfer belt.

Meanwhile, as illustrated in FIG. 17, in Modified Example 5, a plurality of types of diffusion filters 86 having diffusion intensities different from each other are disposed along a surface layer of intermediate transfer belt 421. The diffusion magnification of each diffusion filter 86 is, for example, 1.0, 1.5, 2.0, and 3.0. The plurality of types of diffusion filters 86 are held by a sheet metal of dustproof shutter 88 of a sensor. Control section 100 determines spot diameter Z according to the interval of surface roughness (spot diameter Z larger than the interval of the surface roughness), and moves dustproof shutter 88 along the surface layer such that desired diffusion filter 86 according to the spot diameter Z is disposed on an optical path. Note that control section 100 may determine spot diameter Z on the basis of a table in which spot diameters Z according to the interval of the surface roughness are summarized.

According to Modified Example 5, the plurality of types of diffusion filters 86 are provided so that diffusion filter 86 that can obtain spot diameter Z corresponding to the interval of the surface roughness can be selected from among the plurality of types of diffusion filters 86 even with one photosensor 80.

Modified Example 6

Next, Modified Example 6 will be described with reference to FIG. 18. As illustrated in FIG. 17, in Modified Example 5 described above, a plurality of types of diffusion filters 86 are provided, and spot diameter Z according to the interval of the surface roughness is selected. Meanwhile, as illustrated in FIG. 18, in Modified Example 6, a plurality of types of photosensors 80 having spot diameter Z different from each other are provided.

Figure 18:
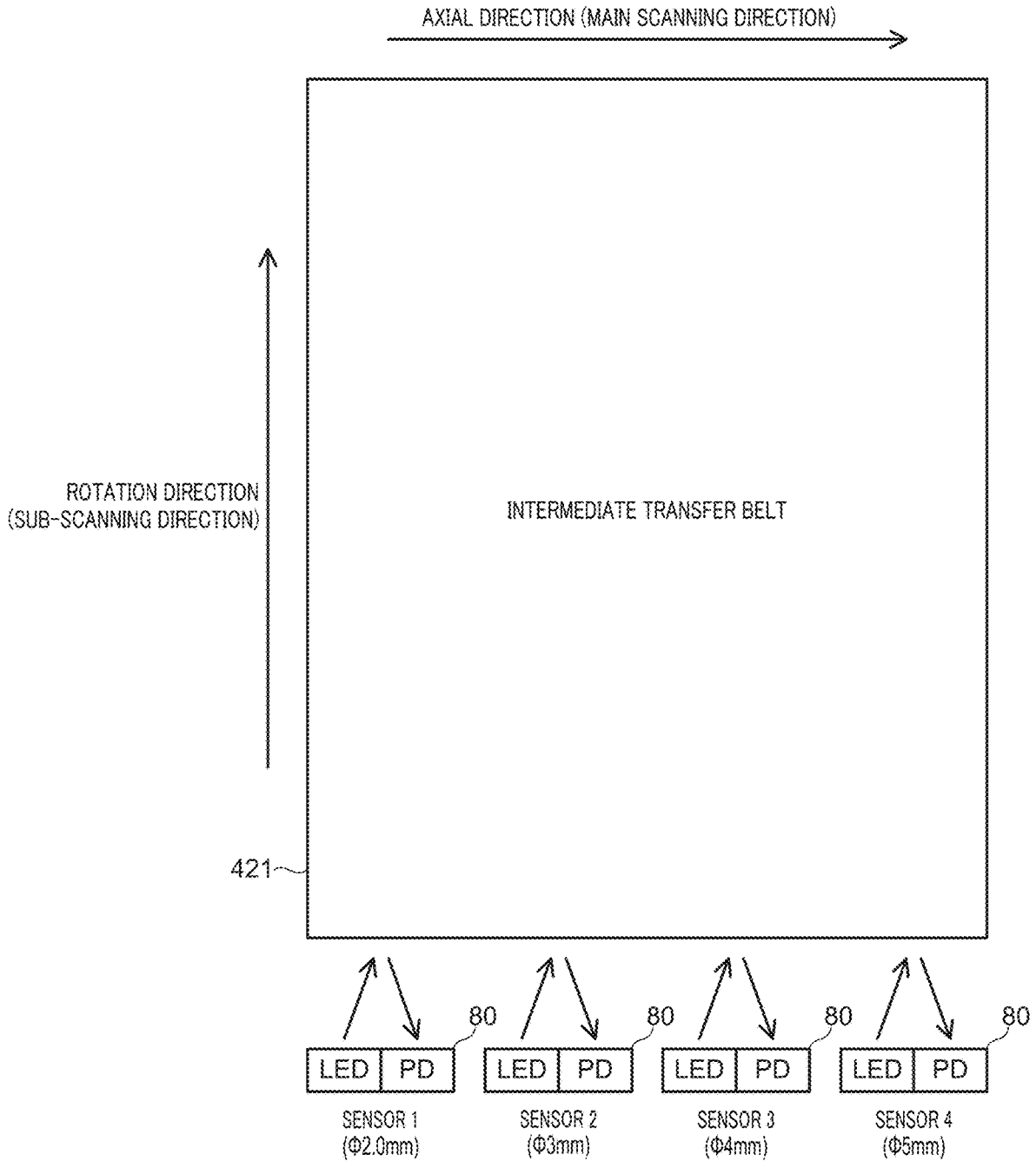
FIG. 18 another diagram schematically illustrating the plurality of types of photosensors disposed along the axial direction of the intermediate transfer belt.

In FIG. 18, the upper direction is a rotation direction (sub-scanning direction) of intermediate transfer belt 421, and the right-left direction is an axial direction (scanning direction) of intermediate transfer belt 421. As illustrated in FIG. 18, the plurality of types of photosensors 80 are disposed in the axial direction. Here, dominant wavelength λp of each photosensor 80 is 850 nm, 700 nm, 550 nm, and 400 nm. Photosensor 80 has spot diameter Z corresponding to dominant wavelength λp. Control section 100 determines spot diameter Z according to the interval of surface roughness (spot diameter Z larger than the interval of the surface roughness), and selects photosensor 80 having the determined spot diameter Z. Note that control section 100 may determine spot diameter Z on the basis of a table in which spot diameters Z according to the surface roughness are summarized.

According to Modified Example 6, the plurality of types of photosensors 80 having spot diameters Z are provided so that photosensor 80 having spot diameter Z according to the interval of the surface roughness can be selected from among the plurality of types of photosensors 80.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus, comprising:

a photosensor;

an image bearing member that has a layered structure in which a surface layer is laminated on a base material layer, the photosensor irradiating a surface of an image bearing member on which a toner image is formed with a detection light beam on the basis of one or more predetermined detection conditions, and receiving a reflected light beam of the detection light beam reflected from the surface of the image bearing ember; and a hardware processor that controls the one or more predetermined detection conditions such that light interference and dark interference are included in the reflected light beam, and that also controls a toner adhesion amount onto the image bearing member on the basis of an output of the photosensor.

2. The image forming apparatus according to claim 1, wherein the hardware processor controls the dominant wavelength to satisfy the following formula (1), $$X > a * \Delta d(\lambda p) \quad (1)$$

wherein, "X" represents a parameter in relation to surface roughness of an outermost layer, "a" represents an arbitrary value of one or more, "λp" represents a dominant wavelength, and "Δd(λp)" represents a difference between a film thickness of the surface layer in a case where the reflected light beam includes the light interference in a dominant wavelength λp and a film thickness of the surface layer in a case where the reflected light beam includes the dark interference.

3. The image forming apparatus according to claim 2, wherein the hardware processor controls the dominant wavelength to satisfy the following formula (2), $$N-0.25 \leq a \leq N+0.25 \quad (2)$$

wherein, "N" represents a positive integer.

4. The image forming apparatus according to claim 3, wherein the hardware processor controls the dominant wavelength to satisfy the following formula (3), $$4 \leq N \leq 8 \quad (3)$$

wherein, "N" represents an integer.

5. The image forming apparatus according to claim 2, further comprising:

a spectroscope that separates a light beam from a white light source, wherein the hardware processor selects a light beam that has the dominant wavelength that satisfies the formula (1) from among light beams resulting from separation by the spectroscope.

6. The image forming apparatus according to claim 2, further comprising:

a plurality of the photosensors that have dominant wavelengths different from each other, wherein the hardware processor selects a photosensor that has the dominant wavelength that satisfies the formula (1) from among the plurality of photosensors.

7. The image forming apparatus according to claim 1, wherein the hardware processor controls a detection range of the photosensor as the one or more predetermined detection conditions to be larger than an interval of the surface roughness.

8. The image forming apparatus according to claim 7, further comprising:

a plurality of diffusion filters that have diffusion intensities different from each other, wherein the hardware processor selects a diffusion filter that obtains the detection range larger than the interval of the surface roughness from among the plurality of diffusion filters.

9. The image forming apparatus according to claim 7, further comprising:

a plurality of the photosensors that have detection ranges different from each other, wherein the hardware processor selects a photosensor that has the detection range larger than the interval of the surface roughness from among the plurality of photosensors.

10. The image forming apparatus according to claim 1, wherein the hardware processor controls at least a dominant wavelength of the photosensor among the one or more predetermined detection conditions.

* * * * *